US006725692B2

(12) United States Patent
Weinraub

(10) Patent No.: US 6,725,692 B2
(45) Date of Patent: Apr. 27, 2004

(54) FIREARM LOCK ASSEMBLY

(75) Inventor: Adam S. Weinraub, Orange, CA (US)

(73) Assignee: Weinraub Enterprises, Inc., Orange, CA (US)

( * ) Notice: Subject to any disclaimer, the term of this patent is extended or adjusted under 35 U.S.C. 154(b) by 0 days.

(21) Appl. No.: 10/255,828

(22) Filed: Sep. 26, 2002

(65) Prior Publication Data

US 2004/0060219 A1 Apr. 1, 2004

(51) Int. Cl.[7] ..... E05B 67/38

(52) U.S. Cl. ..... 70/38 A; 70/49; 70/52; 70/56; 70/417

(58) Field of Search ..... 70/38 A, 49, 52, 70/417, 51, 54–56, DIG. 43, DIG. 56

(56) References Cited

U.S. PATENT DOCUMENTS

| | | | | | |
|---|---|---|---|---|---|
| 405,329 | A | * | 6/1889 | Smith | |
| 1,545,660 | A | | 7/1925 | Johnson | |
| 1,564,462 | A | * | 12/1925 | Best | |
| 1,566,965 | A | | 12/1925 | Johnson | |
| 1,881,809 | A | * | 10/1932 | Maxwell | |
| 2,282,983 | A | * | 5/1942 | Lach | |
| 2,959,951 | A | * | 11/1960 | Mirkin | |
| 3,068,682 | A | * | 12/1962 | Russell et al. | |
| 3,096,962 | A | | 7/1963 | Melis | |
| 3,392,471 | A | | 7/1968 | Foote | |
| 3,546,961 | A | | 12/1970 | Marton | |
| 3,605,458 | A | | 9/1971 | Best | |
| 3,696,647 | A | | 10/1972 | Balicki | 70/49 |
| 3,728,879 | A | * | 4/1973 | Best | 70/38 R |
| 3,738,132 | A | | 6/1973 | Nagel | 70/49 |
| 3,753,360 | A | * | 8/1973 | Bower | 70/39 |
| 3,765,196 | A | | 10/1973 | Balicki | 70/49 |
| 3,765,197 | A | * | 10/1973 | Foote | 70/58 |
| 3,855,824 | A | | 12/1974 | Falk | 70/38 A |
| 3,879,721 | A | | 4/1975 | Yereance | 70/49 X |
| 3,933,015 | A | | 1/1976 | Balicki | 70/49 |
| 4,075,878 | A | | 2/1978 | Best | 70/49 |
| 4,136,539 | A | | 1/1979 | Nobles et al. | 70/18 |
| 4,509,281 | A | | 4/1985 | Dreiling et al. | 42/18 |
| 4,546,345 | A | | 10/1985 | Naito | 70/18 X |
| 4,667,491 | A | * | 5/1987 | Lokken et al. | 70/63 |
| 4,760,719 | A | * | 8/1988 | Evans et al. | 70/18 |
| 4,776,187 | A | * | 10/1988 | Evans et al. | 70/38 A |
| 4,845,967 | A | | 7/1989 | Evans et al. | 70/233 |
| 4,969,342 | A | | 11/1990 | Marchiori | 70/49 |
| 5,153,360 | A | | 10/1992 | Upton | 42/70.11 |
| 5,186,029 | A | * | 2/1993 | Myers | 70/38 A |
| 5,230,231 | A | * | 7/1993 | Liou | 70/38 A |
| 5,363,678 | A | * | 11/1994 | Meckbach | 70/38 A |
| 5,437,119 | A | | 8/1995 | Womack | 42/70.07 |
| 5,447,043 | A | | 9/1995 | Hwang | 70/49 |
| 5,568,740 | A | | 10/1996 | Lin | 70/49 |
| 5,755,121 | A | * | 5/1998 | Crass | 70/52 |
| 5,918,402 | A | | 7/1999 | Weinraub | 42/70.07 |
| 6,073,469 | A | * | 6/2000 | Julien | 70/38 A |
| 6,164,096 | A | * | 12/2000 | Lai | 70/25 |
| 6,250,175 | B1 | | 6/2001 | Noetzold | 74/502.3 |
| 6,305,198 | B1 | * | 10/2001 | Chastain et al. | 70/40 |
| 6,341,509 | B1 | * | 1/2002 | McDaid | 70/39 |
| 6,481,250 | B1 | * | 11/2002 | Kuo | 70/49 |

OTHER PUBLICATIONS

Shot Lock Corp. —Firearm Lock Installation Guide.
Project Homesafe—Lock Installation Instructions.

* cited by examiner

*Primary Examiner*—Lloyd A. Gall
(74) *Attorney, Agent, or Firm*—Harold L. Jackson

(57) ABSTRACT

A lock housing for releasably securing the free end of a cable or shackle in the interior of the housing is in the form of an inner plastic body encapsulated or enclosed within a metal shell. The housing has a top and bottom wall and cable or shackle free end receiving bore. A cavity extends into the housing from the bottom wall with a key lock cylinder mounted therein. The lock cylinder includes a rotatable plug for turning through a predetermined angle from a locked to an unlocked position with a key. A locking member or deadbolt, coupled to the plug, is arranged to move into a detent or groove in the cable or shackle free end to secure the free end in the housing. Rotating the plug to the unlocked position allows the cable of shackle free end to be removed from the housing.

28 Claims, 6 Drawing Sheets

FIREARM LOCK ASSEMBLY

FIELD OF THE INVENTION

This invention relates generally to firearm safety lock devices and more particularly to cable type locks arranged to extend through the barrel and/or the cartridge ejection port.

BACKGROUND OF THE INVENTION

Thousand of handguns, shotguns and rifles are purchased every year by citizens for use in sporting events, such as hunting or trap and skeet shooting, or for use in home protection. Typically, guns are stored at one's home or apartment in drawers, closets or even under the bed. While a minority of gun owners have gun safes to store their guns, most gun owners store their guns in unlocked areas of the home accessible to others dwelling there. As such, guns provide a danger to children or adolescents whose curiosity may lead them to find and play with a gun. Additionally, a child finding a firearm may take it to show friends or take it to school. While adults may believe that guns are safely put away, children and adolescents always seem to find them, and as a result, fatalities and injuries resulting from the accidental discharge of firearms, particularly by children, has become problematic. Also the intentional use of guns by children against classmates and teachers in schools has been increasing over the last several years. Suicides by use of firearms are also at an alarming rate. In response to the rise of this danger, the US Congress and many state legislative bodies throughout the country have enacted or are in the process of enacting legislation requiring that each new purchase or transfer of a gun be accompanied by the purchase or transfer of a suitable lock.

Most conventional gun locks are made of an easily manufactured material such as die cast aluminum or plastic to make the locks economically feasible for the gun manufacturers to bundle with each gun or the gun owner to purchase separately. Such material is subject to being compromised, for example, by forced removal of the lock by a prying and/or sawing attack.

This latter problem came to a head early in 2001 when the California legislature, aware that there were many inadequate gun locks on the market, passed legislation which will make it unlawful for a firearm to be sold or transferred within the State of California after Jan. 1, 2002 without an approved safety device. In implementing the legislation the California Department of Justice, Firearm Division, has required that among other things any approved lock resist destruction of the lock.

Gun locks are typically classified into two categories, i.e., trigger locks and cable locks. Trigger locks such as those disclosed in U.S. Pat. Nos. 5,437,119 and 5,918,402 and application Ser. Nos. 09/593,533, 09/871,753 and 10/029,689, assigned to the assignee of this application, have two sides which clamp around the trigger guard of a gun to prevent access to the trigger. While trigger locks, if properly constructed, function as satisfactory determents to the unauthorized use of a firearm, such locks have a drawback of not insuring that a bullet is not present in the chamber of the locked gun. In addition, trigger locks are generally more expensive than cable locks.

A typical gun cable lock includes an elongated flexible cable which is generally armored, i.e., the individual sockets or links (not shown) are joined together by a twisted wire with the links being made of hardened steel to deter access to the inner wire. The flexible cable is shown in FIG. 1 as being threaded through the barrel 12 of a handgun 14. The fixed end 10*a* of the cable is secured within a lock housing 16 by means of a sheave 16*b* wedged within a groove 10*b* in the fixed end. See FIGS. 2–4. The lock housing is formed from a plurality of steel laminations 16*c* secured together via rivets 16*d* and includes a cable free end receiving bore 16*e* within which is positioned a plunger member 18 biased upwardly by compression spring 20. See FIG. 2. A plastic cover 22 encompasses the sides and a portion of the top and bottom of the housing.

A conventional key cylinder lock 28, mounted in the lock housing, includes a spring biased split tumbler casing 28*a* and a plug or inner barrel 28*b* which is rotatable, through a given angle, 90° or less, with a key 29. The plug 28*b* is formed with two upwardly projecting spaced posts 28*c* positioned on the underside 30*a* of a cam 30 which includes downwardly projecting triangular-shaped stops 30*b*. Only one of the posts is shown in FIGS. 2–4. The stops 30*b* are engaged by the posts 28*c* to rotate the cam to its unlocked position by action of the key 29 as will be explained. An upstanding rib 30*c* and a short spring retaining rod 30*d* are formed on the upper surface 30*e* of the cam. See FIGS. 7 and 8. A spiral spring 32 extends between a center in the rod 30*d* and a stationary notch 16*f* in one of the laminated plates, to bias the cam in a counterclockwise direction viewing the top surface of the cam as is illustrated in FIG. 7. The cam and bias spring are sometimes referred to as a spring/cam assembly herein.

A locking member or bar 34 rides on the upper surface 30*e* of the cam and is biased toward the bore 16*e* but prevented from entering the bore by the spring biased plug 18 unless the free end of the cable has depressed the plunger and placed an annular groove 10*c* at the cable free or active end 10*d* opposite the locking member 34. In this case, the locking member is pushed by the rib 30*c* into the groove via the action of spring 32 to lock the cable free end 10*d* to the housing.

The prior cable lock housings, designed to deter a cutting or sawing attack, employ hardened steel laminations with non-hardened rivets to secure the laminations together. While the laminations are stamped out and partially assembled by automatic machines there is still some hand labor involved in inserting the key lock cylinder, cam, locking bar, sheave and plunger/spring components (if used) during the assembly process. In total about 20 laminations, 4 rivets, a key cylinder, a locking bar and a cam (assuming that the plunger/spring is not used) are needed for each lock housing.

There is a need for a simpler, less expensive and lighter lock housing for cable locks designed to meet anti-strict testing criteria now in place in at least one state and under consideration at the Federal Government.

SUMMARY OF THE INVENTION

In accordance with the present invention an elongated cable, preferably armored, or alternatively a shackle, is provided with a free end. The free end of the cable is adapted to be inserted through a barrel, cartridge ejection port or magazine chamber of a firearm and a fixed end which is not insertable through such firearm. The shackle is adapted to be inserted through a hasp, for example. The free end defines an annular groove or detent.

A lock housing, formed of an inner plastic body encapsulated or enclosed within a metal shell, has a top and bottom wall and a cable (or shackle) free end receiving bore defining a longitudinal axis extending from the top wall and capturing the fixed end of the cable. The housing further includes a lock cylinder cavity extending into the housing from the bottom wall and also oriented parallel to the longitudinal axis, the housing having a key access opening into the cavity.

A key lock cylinder is mounted in the cavity and includes a rotatable plug for receiving and turning through a predetermined angle from a locked to an unlocked position with a key. A locking member or deadbolt is coupled to the cylinder and arranged for movement out of the cable (or shackle) free end receiving bore when operated by the key to enable the cable or shackle free end to be removed from the housing. Preferably the deadbolt or locking member moves into and out of the cable free end receiving bore only in response to the rotation of the plug to the locked (first) and unlocked (second) positions, respectively.

The construction and operation of the invention can best be understood by reference to the following description taken in conjunction with the accompanying drawings wherein like components are given the same reference numeral in the several figures.

DESCRIPTION OF THE PREFERRED EMBODIMENT

Figure 10:
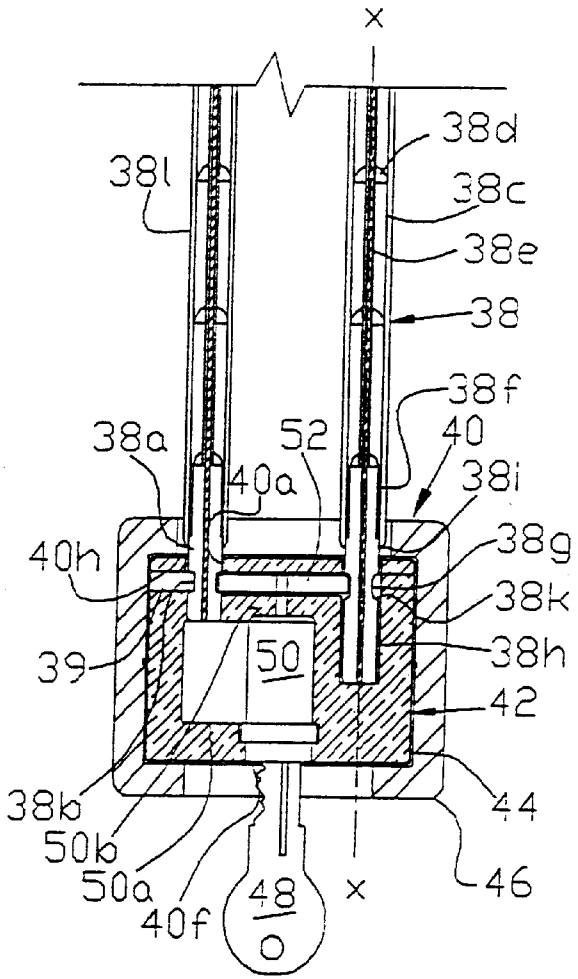
FIG. 10 is a side elevation cross-sectional view of a cable and gun lock housing in accordance with the present invention with the cable free endlocked in the lock housing.

Referring now to the drawings and particularly to FIG. 10 the fixed end 38*a* of an articulated cable (preferably armored) is secured within a opening 40*a* of a lock housing 40 by means of a sheave 39 wedged into a groove 38*b*.

The cable is formed by metal sleeves or links 38*c* made, for example, of hardened steel and formed with a convex portion 38*d* at one end which extends into the adjacent link to provide the articulation necessary to allow the cable to be threaded through a gun barrel, cartridge ejection chamber or magazine chamber (hereinafter collectively referred to as the "barrel"). A central twisted wire 38*e* extends through the links and is crimped to the fixed end and also to a free or active end 38*f* to join the links together. The free or active end of the cable defines an annular groove 38*g* formed by a reduced diameter section bounded by a lower section 38*h* and an upper section 38*i*. The junction between the reduced section and lower section 38*h* forms a shoulder 38*k* which functions in conjunction with a rotatable or pivotal cam or deadbolt 52 to lock the cable free end in the housing as will be explained.

A plastic sleeve or coating 38*l* encloses the links to prevent marring of a gun barrel, etc. The diameter of the cable is preferably small enough to be threaded through the barrel of one of the smaller guns such as a 22 caliber. A diameter of about 0.215 inches has been found to be satisfactory for this purpose.

Figure 11:
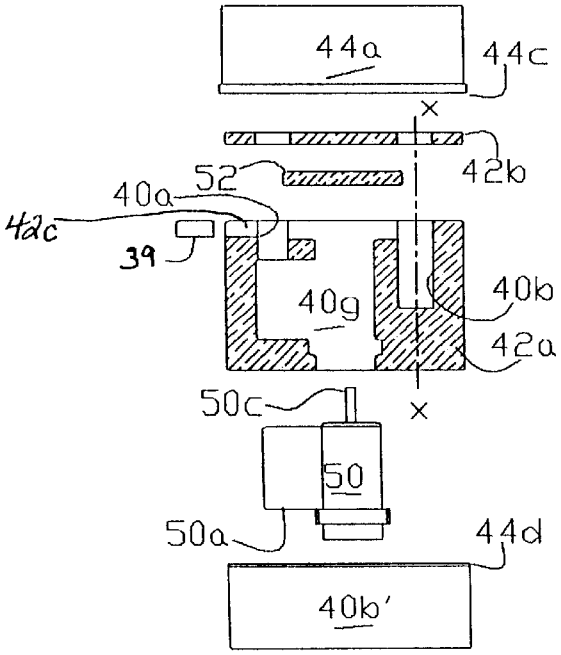
FIG. 11 is an exploded unassembled view of the lock housing of FIG. 10, without the key and with the inner body component shown in cross-section.
Figure 12:
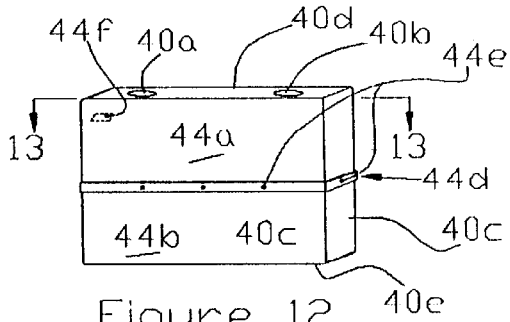
FIG. 12 is a perspective view of the assembled lock housing.
Figure 16:
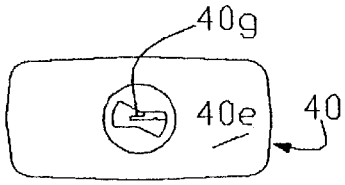
FIG. 16 is a bottom view of the lock housing.

The lock housing 40 is formed of an inner plastic body 42 encapsulated within a saw-resistant shell 44 as will be explained in more detail with respect to FIGS. 11–13. The lock housing includes a first blind bore 40*b* (FIG. 16), which defines a longitudinal axis x—x, for receiving the cable free end and a second blind bore 40*a*, parallel to bore 40*b* for receiving the fixed end of the cable. A rubber boot 46 is fitted around the sides 40*c*, the top wall 40*d* and bottom wall 40*e* (FIG. 12) of the housing leaving the cable openings 40*a* and 40*b* and an access opening 40*f* for a key 48.

Figure 1:
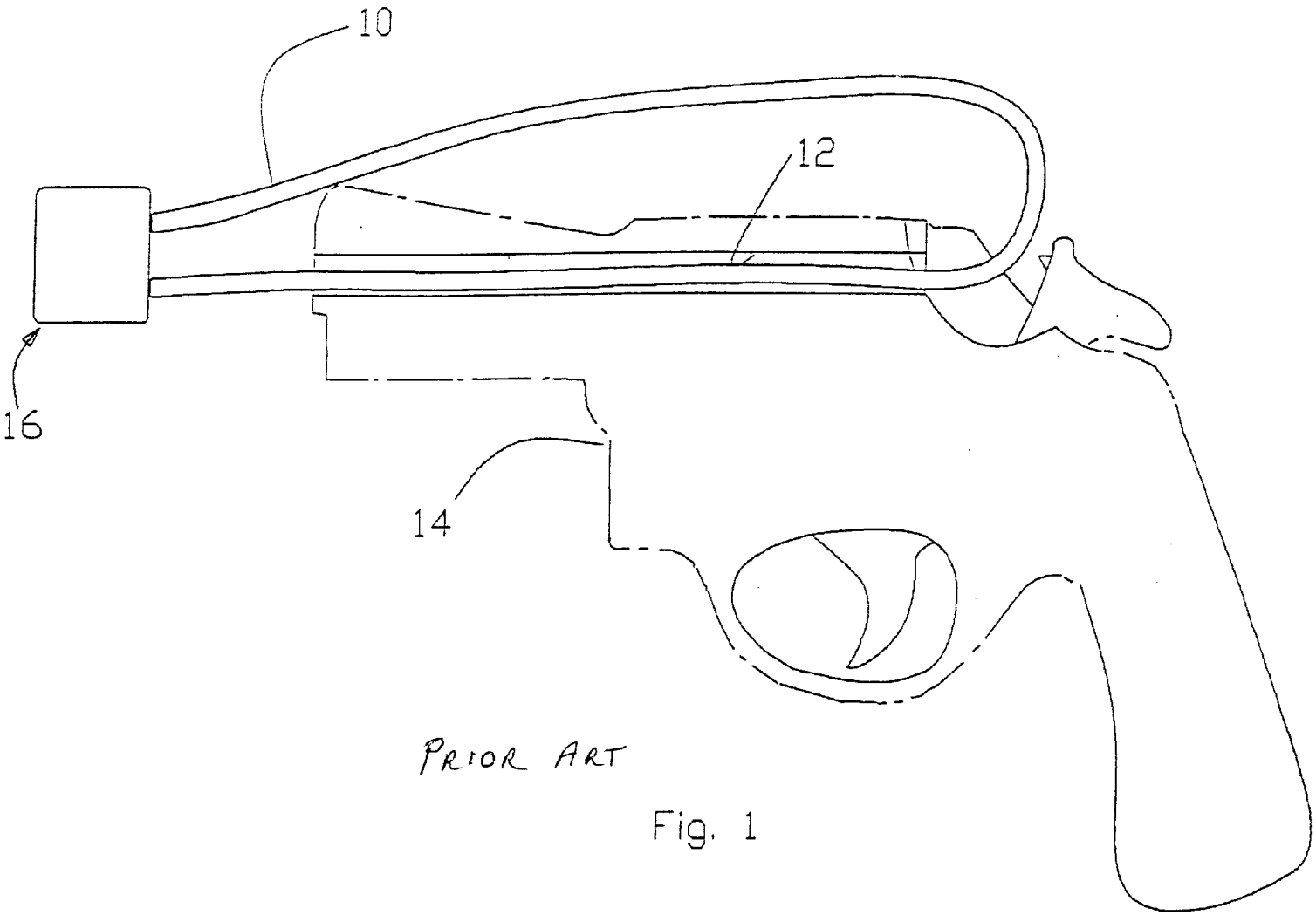
PRIOR ART Fig. 1
FIG. 1 is a diagrammatic view of a cable gun lock in use to deny authorized access to the firearm.
Figure 4:
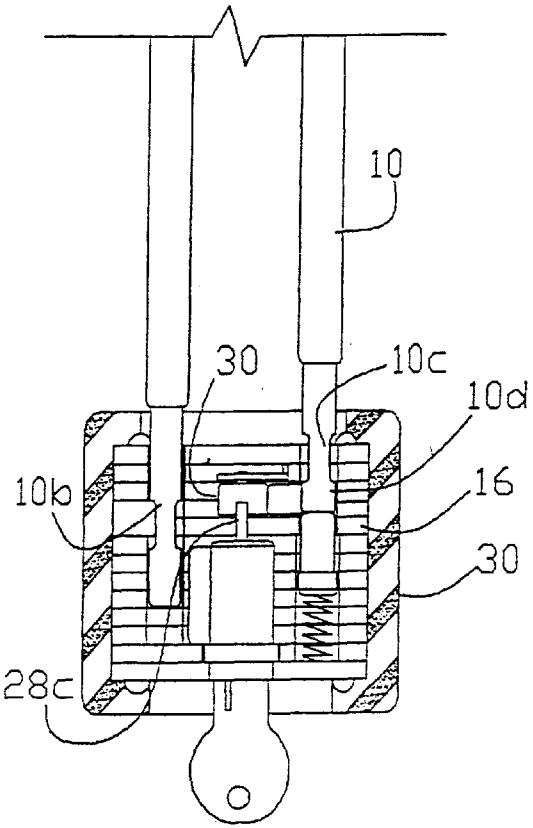
Fig.4 Prior Art
FIG. 4 is a cross-sectional view of the gun lock housing of FIG. 3 showing the free end of the cable inserted part way into the housing.
Figure 3:
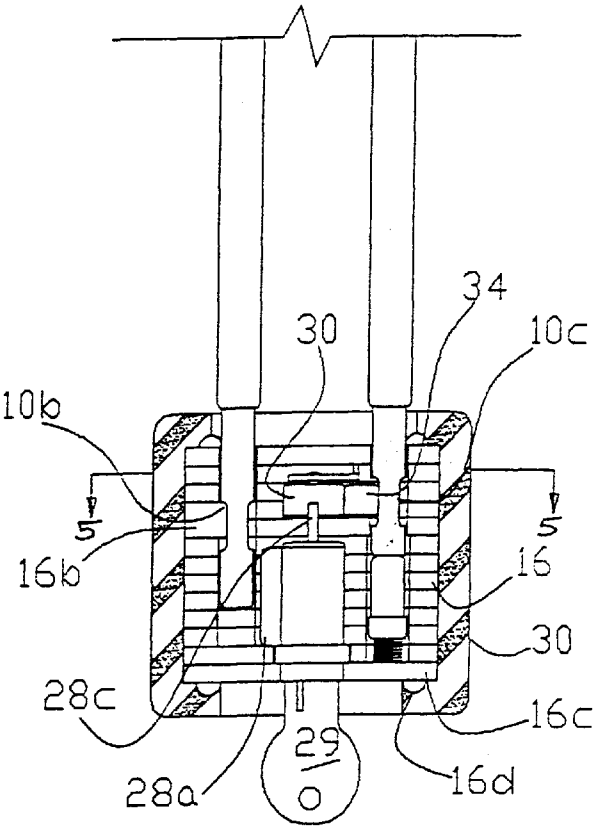
Fig. 3 Prior Art
FIG. 3 is a cross-sectional view of the gun lock housing of FIG. 2 with the free end of the cable locked inside the housing.

A conventional key lock cylinder 50 is mounted in a housing cavity 40*g*, which cavity is aligned along an axis parallel to the axis x—x. A split tumbler casing 50*a* functions with the key 48 to allow an inner barrel or plug 50*b* of the key cylinder to rotate through about a given angle, i.e., 90° or less, from a first position which may (but need not be) the locked position (FIG. 13) to a second unlocked position (FIG. 14). It is to be noted that the first position of the plug may merely allow the locking member to move into the cable free end groove under the force of a spring as is illustrated in FIGS. 2–4.

Figure 8:
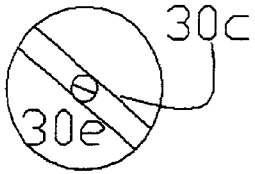
Fig. 8 Prior Art
FIG. 8 is a top view of the cam in the unlocked position.
Figure 9:
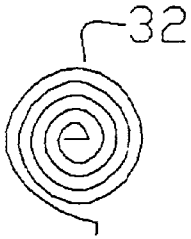
Fig. 9 Prior Art
FIG. 9 is a top plan view of a spiral spring for biasing the cam and locking member towards the locked position.
Figure 5:
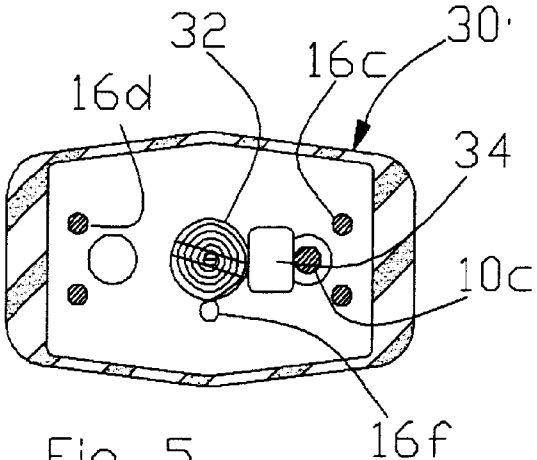
Fig. 5 Prior Art
FIG. 5 is a cutaway view of the housing taken along lines 5—5 of FIG. 3 showing the position of a locking member and cam in the locked position.
Figure 13:
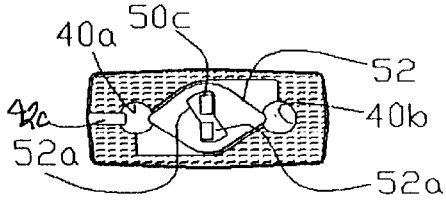
FIG. 13 is a cross-sectional view taken along lines 13 of FIG. 12 showing the cam or deadbolt in a locked position.
Figure 14:
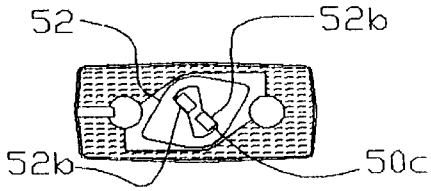
FIG. 14 is a cross-sectional view taken along line 13—13 showing the deadbolt in an unlocked position.
Figure 15:
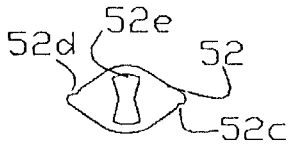
FIG. 15 is a top plan view of the deadbolt.

A pair of upwardly protruding posts 50*c* formed integrally with the plug, engage lock and unlock actuating shoulders 52*a* and 52*b*, respectively, formed by a FIG. 8-shaped opening, in a deadbolt 52 as is illustrated in FIGS. 13 and 14. The deadbolt, sometimes referred to as a locking member or cam, is preferably made of a metal such as steel. The deadbolt is planar in form and lies in a plane perpendicular to the longitudinal axis as illustrated. The deadbolt preferably terminates at one end in protruding tip 52*c* (as shown in FIG. 15) which extends into and out of the cable free end receiving bore 40*b* when the plug is rotated to its locked and unlocked position, respectively. The other end of the deadbolt terminates in a tip 52*d* which is arranged to extend into the groove 38*b* in the locked position (FIG. 10) to function along with the sheave 39 to maintain the fixed end of the cable within the lock housing. It is to be noted that the extension of the deadbolt tip 52*d* into the groove in the fixed cable end is optional.

Figure 2:
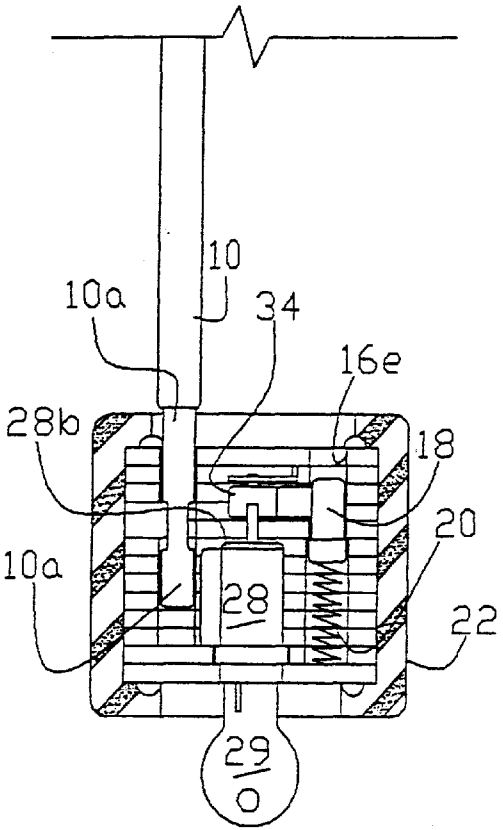
Fig.2 Prior Art
FIG. 2 is a side elevational view of a prior art cable lock with the free or active end of the cable located outside of a lock housing with the housing shown in a cross-sectional view.
Figure 6:
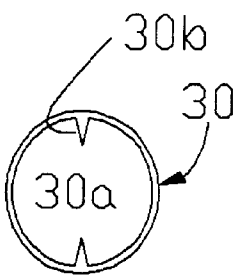
Fig. 6 Prior Art
FIG. 6 is a bottom view of the cam of FIG. 5.
Figure 7:
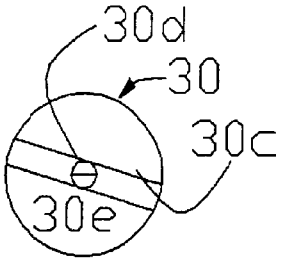
Fig. 7 Prior Art
FIG. 7 is a top view of the cam of FIG. 5 in the locked position.

It should be noted that the locking member may be in the form of a ball, plate or bar such as item 34 in FIG. 2. A cam such as item 30 in FIG. 2 and bias spring, item 32 (FIG. 5) may be used to force the locking member into the cable free end groove as is illustrated in FIGS. 2–8. With this arrangement rotation of the plug to the unlocked position allows the locking member to be moved out of the cable receiving bore so that the free end of the cable may be removed from the housing.

While the plug 50*b* rotates through an angle of about 45° between the unlocked (FIG. 14) and locked (FIG. 13) positions the cam rotates through a smaller angle of about 20°. This action accommodates the relatively narrow width of the lock housing.

The key lock cylinder is preferably arranged so that the key can only be inserted and withdrawn when the plug is in the locked position, i.e., with the cam tips extending into the cable receiving bores. This ensures that the key cannot be withdrawn with the cable free end only partially inserted into the bore 40*b* as is illustrated in FIG. 10. The cable free end must be inserted fully, i.e., a predetermined distance, into the bore 40*b* before the key 48 can be removed from the lock. This arrangement greatly reduces the possibility that a user will mistakenly believe that the cable is secured to the lock housing.

Referring again to FIGS. 11–13 the housing shell 44 comprises two generally rectangular cup-shaped sections, i.e., lower and upper sections 44*b* and 44*a*, respectfully. The upper section 44*a* defines the entrance to the fixed and free end cable receiving bores 40*a* and 40*b*. In addition, the lower casing defines a key access opening 40*g* which allows the entry of the key 48 into the lock cylinder 50, but extends over the lock shear line to deter one from drilling out the lock. See FIG. 16. The plastic body 42 is preferably molded, by the injection process, from a suitable substantially rigid and preferably light weight material, such as ABS. The body 42 includes a lower body section 42*a* and an upper plate-like section 42*b*. A suitable fiber filler may be added to the plastic for added strength.

In the assembly process the cylinder lock is inserted into the lower body section 42*a*. The deadbolt or cam 52 is then inserted into the lower body section 42*a* with the central opening 52*e* therein extending over the plug posts 50*c* as is illustrated in FIGS. 13 and 14. The upper body plate section 42*b* is then placed over the deadbolt plate to complete the inner assembly process. The upper and lower shell sections 44*a* and 44*b* are inserted over the body 42 with an outwardly extending flange 44*c* on the upper section fitted over bead 44*d* on the lower section to form a seam line 44*d* perpendicular to the longitudinal axis as shown. The upper and low shell sections are secured along the seam line by suitable means such as spot welding at locations 44*e*. The upper shell section 44*a* is formed with an opening 44*f* which coincides with a slot 42*c* in the plastic body in the assembled condition to receive the sheave 39 to lock the fixed end of the cable in the housing. The rubber boot is molded over the housing leaving openings 40*a* and 40*b* and an opening providing access to the bottom of the key lock cylinder. The cable fixed end can be secured in the bore 40*a* via the sheave 39 before or after molding the rubber boot onto the housing. The shell 44 is preferably made of hardened steel and have a Rockwell C shore hardness of about 30 or greater and most preferably about 40 or greater. A Rockwell C hardness of about 60 has been found to provide considerable saw and cutting resistant protection. The shell thickness may be within the range of about 0.010 to 0.100 inches and is preferably within the range of about 0.020 to 0.060 inches. A thickness of about 0.040 inches has been found to be quite satisfactory.

Figure 17:
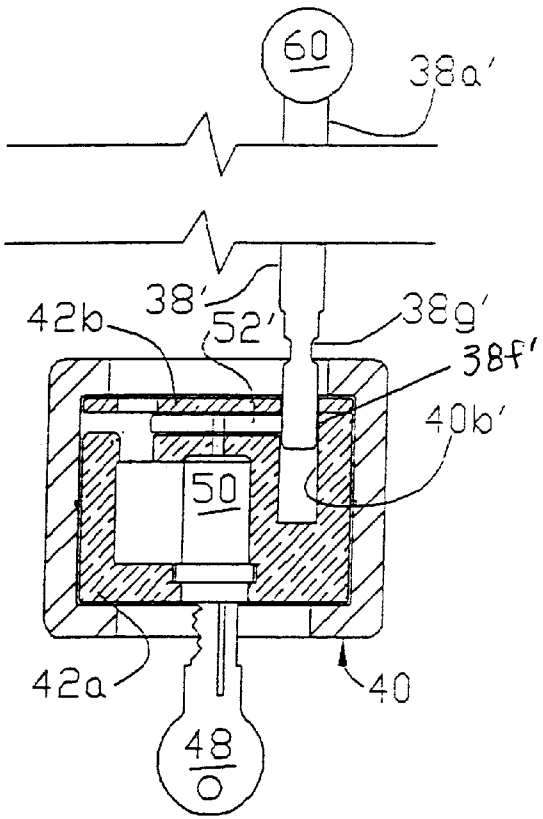
FIG. 17 is a cross-sectional view of an alternative embodiment of the invention in which the free or second end of the cable is secured to an enlarged member for preventing the movement of such end through a gun barrel or cartridge ejection chamber.

Referring now to FIG. 17 a lock assembly is shown in which a cable 38' includes a free end 38*f'* insertable into bore 40*b'* and secured therein (in the locked position) by arm 52' which extends into groove 38*g'*. The lock is illustrated in FIG. 17 in its unlocked condition. The cable fixed or second end 38*a'* comprises an enlarged member 60, for example, in the form of a metal ball, to preclude the second end from passing through a gun barrel or cartridge ejection chamber. The upper section 44*a* of the shell 44 need be provided with only one cable receiving bore. Except for such differences, the lock assembly of FIG. 17 functions in the same manner as the lock assembly of FIGS. 10–15.

Figure 19:
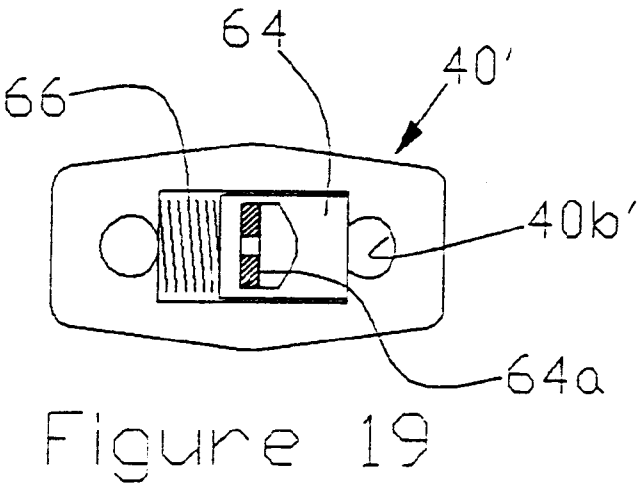
FIG. 19 is a cross-sectional view of the lock taken along lines 19—19 of FIG. 18.
Figure 18:
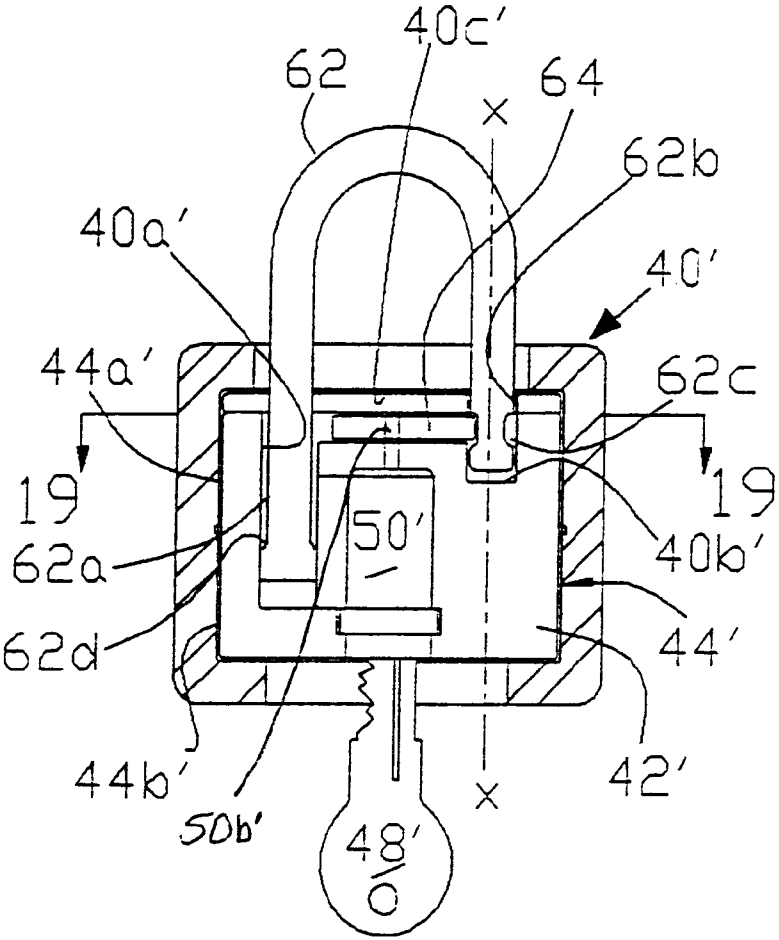
FIG. 18 is a cross-sectional view of a conventional type shackle padlock utilizing the present invention.

Referring now to FIGS. 18 and 19, there is shown a conventional type shackle padlock in which the lock housing 40' is formed of an inner plastic body 42' encapsulated within a metal shell 44', preferably made of hardened steel and including upper and lower sections 44*a'* and 44*b'* welded or otherwise secured together, as discussed with respect to FIG. 10, etc. The first and second blind bores 40*a'* and 40*b'*, respectively, receive the fixed end 62*a* and the free end 62*b* of a swivel shackle 62. The bore 40*b'* defines the longitudinal axis x—x. The housing includes a cavity for the cylinder lock 50' as illustrated. A plate or locking member 64 is biased by a compression spring 66 into the bore 40*b'* to engage a groove or indent 62*c* in the free end of the shackle and maintain it in a locked position. A key 48', when rotated clockwise or counterclockwise, causes the rotatable plug 50*b'* to engage a shoulder 64*a* on the plate (or cam) 64 and force it against the spring and out of the groove 62*c* to unlock the padlock. A shoulder 62*d* on the bottom of the shackle fixed end and the narrow opening 40*c'* in the upper shell section retain that end in the lock housing in a conventional manner.

The lock housing for releasably securing a cable to a firearm to deter the unauthorized use thereof or for releasably securing the free end of a shackle in a conventional shackle type padlock is simple, reliable and relatively inexpensive to manufacture. The housing comprises as few as six parts as compared with conventional laminated lock housings which comprises as many as twenty-five (25) or more separate parts. The savings in manufacturing material and labor is estimated to be about 25% or more. In addition, there is a considerable saving in weight, e.g., 4.4 ounces versus 7+ ounces which can make a difference in freight costs when shipped separate or with a firearm.

Various modifications of the lock housing will undoubtedly occur to those skilled in the art without involve a departure from the spirit and scope of the present invention as called for in the appended claims.

What is claimed is:

1. A lock assembly for securing firearms against unauthorized access comprising:

an elongated flexible cable having a free end adapted to be inserted into a barrel or chamber of a firearm and a second end which is not insertable through the barrel or chamber, the free end defining an annular groove;

a lock housing formed of an inner plastic body encapsulated within a saw resistant shell the shell being formed of hardened steel having a Rockwell hardness of about 30 or greater, the housing having a top and bottom wall and forming a cable receiving bore extending into the housing from the top wall along a longitudinal axis, a key lock cylinder cavity oriented parallel to the longitudinal axis and having a key access opening in the bottom wall;

a key lock cylinder mounted in the cavity and having a rotatable plug for receiving and turning through a predetermined angle from a first position to an unlocked position with a key; and a locking member coupled to the cylinder plug and arranged for insertion into the cable free end annular groove to lock the free end into the housing, the cable free end being free to be removed from the housing in response to the rotation of the plug to the unlocked position.

2. The lock assembly of claim 1 wherein the shell comprises two cup-shaped sections, each section having a peripheral edge, the edges being secured together.

3. The lock assembly of claim 1 wherein the locking member is biased into the cable free end receiving bore and into the annular groove in the cable free end when inserted a predetermined distance into the bore.

4. The lock assembly of claim 1 wherein the first position of the rotatable plug is the locked position with the locking member inserted into the cable free end groove when the plug is in the locked position.

5. The lock assembly of claim 1 wherein the shell has a Rockwell C hardness of about 50 or greater.

6. The lock assembly of claim 1 wherein the shell has a thickness within the range of 0.020 to 0.100 inches.

7. The lock assembly of claim 1 wherein the plastic body is formed of ABS plus a fiber filler.

8. The lock assembly of claim 1 wherein the annular groove is defined by upper and lower cylindrical sections of substantially one diameter separated by an intermediate section of a reduced cross-sectional dimension so that the locking member extends into the intermediate section to secure the cable free end in the housing and locked position.

9. The lock assembly of claim 8 wherein the locking member is arranged to move laterally at a substantially right angle to the longitudinal axis.

10. The lock assembly of claim 9 wherein the lock cylinder is arranged so that the key is removable only when the plug is turned to the locked position.

11. The lock assembly of claim 10 wherein the lower section of the cable free end interferes with the movement of the locking member into the cable receiving bore when the cable free end is inserted into the bore a distance less than the predetermined distance to prevent removal of the key.

12. The lock assembly of claim 9 wherein the second end of the cable is secured to the lock housing.

13. The lock assembly of claim 9 wherein the second end of the cable is secured to an enlarged member separate from the lock housing.

14. The lock assembly of claim 9 wherein a protruding post is secured to the plug and wherein the locking member is a driven directly by the post.

15. The lock assembly of claim 1 wherein the plug carries at least one projecting post rotatable therewith and a planar deadbolt mounted in the housing for rotation with the post, the deadbolt being arranged to extend into the cable receiving bore and the annular groove in the free end of the cable when the plug is turned in one direction to lock the free cable end and to be withdrawn from the cable receiving bore when the plug is turned in an opposite direction to allow the cable free end to be withdrawn from the housing.

16. The lock assembly of claim 15 wherein the plug is arranged to rotate between an unlocked position in which the deadbolt is retracted from the bore to a locked position in which the deadbolt is extended into the bore and wherein the free end of the cable includes a cylindrical stub extending below the annular groove, the stub being arranged to engage the deadbolt when the free end is not fully inserted into the blind bore and prevent the plug from turning to its locked position.

17. The lock assembly of claim 16 wherein the first bore defines a longitudinal axis and wherein the lock housing defines a second bore aligned parallel to the longitudinal axis with the second end of the cable secured therein, the second end of the cable including a groove and wherein the deadbolt includes first and second ends with the first and second ends being arranged to extend into the grooves in the free and second cable ends of the cable when the plug is turned to the locked position.

18. The lock assembly of claim 17 wherein the deadbolt is made of steel.

19. The lock assembly of claim 17 wherein said at least one projecting post comprises a plurality of spaced posts extending parallel to the longitudinal axis.

20. The lock assembly of claim 17 wherein the deadbolt lies in a plane substantially perpendicular to the longitudinal axis.

21. The lock assembly of claim 19 wherein the deadbolt arm defines a centrally disposed cavity through which the posts extend.

22. The lock assembly of claim 21 wherein the cavity forms a pair of lock and unlock actuating shoulders which are engaged by the posts when the plug of the lock cylinder is turned to its locked and unlocked positions, respectively.

23. The lock assembly of claim 22 wherein the flexible cable is armored.

24. In a padlock housing for releasably securing a free end of a shackle, the shackle having an indent on the free end thereof, the housing comprising:

an inner plastic body encapsulated within a saw resistant metal shell, the shell being formed of hardened shell having a Rockwell C hardness of about 30 or greater the body and shell having a top and bottom wall, the body and shell forming a shackle free end receiving bore extending into the housing from the top wall along a longitudinal axis and a key lock cylinder cavity oriented parallel to the longitudinal axis and having a key access opening in the bottom wall;

a key lock cylinder mounted in the cavity and having a rotatable plug for receiving and turning through a predetermined angle from a first position to a second unlocked position with a key; and a locking member coupled to the cylinder plug for insertion into the shackle indent to lock the shackle free end into the housing, the shackle free end being free to be removed from the housing in response to the rotation of the plug to the unlocked position.

25. The padlock housing of claim 24 wherein the shell comprises two cup-shaped sections, each section having a peripheral edge, the edges being secured together.

26. The padlock housing of claim 25 wherein the shackle includes a second end and the housing forms a second bore aligned parallel to the longitudinal axis for receiving the second end of the shackle.

27. The padlock housing of claim 26 wherein the locking member is in the form of a planar deadbolt mounted in the housing for rotation with the cylinder plug, the deadbolt having a tip arranged to extend into the shackle free end receiving bore when the plug is turned to the locked position and to be withdrawn from the shackle free end receiving bore when the plug is turned to the unlocked position.

28. The padlock housing of claim 26 wherein the peripheral edge of the two cup-shaped shell sections are welded together.

* * * * *